US009200373B2

(12) United States Patent
Zeng et al.

(10) Patent No.: US 9,200,373 B2
(45) Date of Patent: Dec. 1, 2015

(54) SIMULTANEOUSLY QUANTIFYING AN ALKANE AND OXYGEN USING A SINGLE SENSOR

(71) Applicant: Oakland University, Rochester, MI (US)

(72) Inventors: Xiangqun Zeng, Rochester Hills, MI (US); Zhe Wang, Auburn Hills, MI (US)

(73) Assignee: Oakland University, Rochester, MI (US)

( * ) Notice: Subject to any disclaimer, the term of this patent is extended or adjusted under 35 U.S.C. 154(b) by 0 days.

(21) Appl. No.: 14/218,817

(22) Filed: Mar. 18, 2014

(65) Prior Publication Data

US 2014/0197045 A1 Jul. 17, 2014

Related U.S. Application Data

(63) Continuation-in-part of application No. 13/597,071, filed on Aug. 28, 2012.

(51) Int. Cl.

| | |
|---|---|
| ***C07C 27/10*** | (2006.01) |
| ***C07C 29/10*** | (2006.01) |
| ***C07C 35/00*** | (2006.01) |

(Continued)

(52) U.S. Cl.

CPC ... *C25B 3/00* (2013.01); *C25B 3/02* (2013.01); *C25B 9/08* (2013.01)

(58) Field of Classification Search

None

See application file for complete search history.

(56) References Cited

U.S. PATENT DOCUMENTS

2012/0029245 A1 2/2012 Corradini et al.

OTHER PUBLICATIONS

Zhdanov et al. "Simulation of Methane Oxidation on Pt", Journal of Chemical Physics 126, (2007), pp. 234705-1-234705-6.

(Continued)

*Primary Examiner* — Clinton Brooks

(74) *Attorney, Agent, or Firm* — Dierker & Associates, P.C.

(57) ABSTRACT

An alkane gas is supplied to an interface between an activated surface of a platinum or palladium working electrode and an ionic liquid electrolyte. The alkane adsorbs at or near an interface complex formed at the interface. The ionic liquid electrolyte is selected from a group consisting of 1-ethyl-1-methylpyrrolidinium bis(trifluoromethylsulfonyl)imide, 1-propyl-1-methylpyrrolidinium bis(trifluoromethylsulfonyl)imide, 1-butyl-1-methylpyrrolidinium bis(trifluoromethylsulfonyl)imide, 1-pentyl-1-methylpyrrolidinium bis(trifluoromethylsulfonyl)imide, 1-hexyl-1-methylpyrrolidinium bis(trifluoromethylsulfonyl)imide, 1-heptyl-1-methylpyrrolidinium bis(trifluoromethylsulfonyl)imide, 1-octyl-1-methylpyrrolidinium bis(trifluoromethylsulfonyl)imide, 1-nonyl-1-methylpyrrolidinium bis(trifluoromethylsulfonyl)imide, and 1-decyl-1-methylpyrrolidinium bis(trifluoromethylsulfonyl)imide, and combinations thereof. While the alkane gas in the presence of oxygen is supplied to the interface, positive electrode potential is applied to the platinum or palladium working electrode, which causes oxidation of the adsorbed alkane to form a reaction product. A concentration of the alkane is quantified using an alkane anodic current or current density at the positive electrode potential. The alkane is used as an internal standard to calibrate oxygen detection.

10 Claims, 8 Drawing Sheets

(51) Int. Cl.

| | |
|---|---|
| ***C07C 29/00*** | (2006.01) |
| ***C07C 31/00*** | (2006.01) |
| ***C07C 31/02*** | (2006.01) |
| ***C07C 33/00*** | (2006.01) |
| ***C07C 27/00*** | (2006.01) |
| ***C25B 3/00*** | (2006.01) |
| ***C25B 3/02*** | (2006.01) |
| ***C25B 9/08*** | (2006.01) |

(56) References Cited

OTHER PUBLICATIONS

Rosen et al. "Ionic Liquid-Mediated Selective Conversion of CO2 to CO at Low Overpotentiais", Science, vol. 334, Nov. 4, 2011, pp. 643-644 (supporting materials 13 pages).
Bernskoetter et al, "Characterization of a Rhodium(l)σ-Methane Complex in Solution", Science, vol. 326, Oct. 23, 2009, pp. 553-556.
Periana et al. "Catalytic, Oxidative Condensation of CH4 to CH3COOH in One Step Via CH Activation", Science, vol. 301, Aug. 8, 2003, pp. 814-818.
Shu, et al. "An Fe2(IV)O2 Diamond Core Structure for the Key Intermediate Q of Methane Monooxygenase", Science, vol. 275, Jan. 24, 1997, pp. 515-518.
Ermler et al. "Crystal Structure of Methyl-Coenzyme M Reductase: The Key Enzyme of Biological Methane Formation", Science, vol. 278, Nov. 21, 1997, pp. 1457-1462.
Himes et al. "A New Copper-Oxo Player in Methane Oxidation", PNAS, Nov. 10, 2009, vol. 106, No. 45. pp. 18877-18878.
Sobota, Toward lon.-Liq.-Based Mod. Cat,:Growth,Orient.,Conf. & Int. Mech.Of the [Tf.2N] An. on [BMIM][Tf2N] Thn Flms on a Well-Ord.Alum.Surf.,Langmuir 2010,26(10) 7199-7207.
Burch et al. "Kinetics and Mechanism of the Reduction of NO ny C3H8 over Pt/Al203 under Lean-Burn Conditions", J. of Catalysis 169, (1997), pp. 45-54.
Zhdanov et al. "Simulation of the Kinetics of Oxidation of Saturated Hydrocarbons on Pt", J. of Catalysis 195, (2000), pp. 46-50.
Vayenas et al. "Dependence of Catalytic Rates on Catalyst Work Function", Letters to Nature, vol. 343, Feb. 15, 1990, pp. 625-627.

[$C_4$ mpy] [$NTf_2$]

SIMULTANEOUSLY QUANTIFYING AN ALKANE AND OXYGEN USING A SINGLE SENSOR

CROSS-REFERENCE TO RELATED APPLICATIONS

This application is a continuation-in-part application of co-pending U.S. patent application Ser. No. 13/597,071, filed on Aug. 28, 2012 and entitled "Aerobic Oxidation of Alkanes", which is incorporated by reference in its entirety.

STATEMENT REGARDING FEDERALLY SPONSORED RESEARCH OR DEVELOPMENT

This invention was made with government support under Grant Nos. 1R21OH009099-01A1 and 1R01OH009644-01A1 by the National Institute for Occupational Safety and Health (NIOSH). The government has certain rights in the invention.

BACKGROUND

Methane is the main constituent of natural gas. In nature, methane oxidizes to methanol at room temperature via methane monooxygenase enzymes that have iron-oxygen or copper-oxygen sites. The electrochemical oxidation of methane is thermodynamically favored, and thus attempts have been made to reproduce the reactivity of methane monooxygenase enzymes using a variety of electrochemical techniques. The direct oxidation of methane at low temperatures (e.g., from about 60° C. to about 150° C.) has been demonstrated with electrode systems utilizing acid electrolytes or polyelectrolytes. However, these systems exhibit extremely slow electrode kinetics at room temperature. The replication of the efficiency of nature's enzymatic oxidation of methane has proven to be challenging and difficult, especially using electrochemistry.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
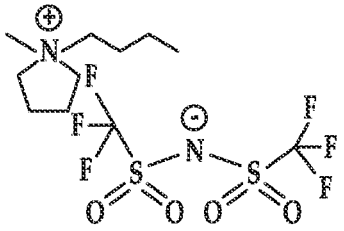
FIG. 1 is the structural formula of 1-butyl-1-methylpyrrolidinium bis(trifluoromethylsulfonyl)imide.

The present disclosure relates generally to the simultaneous quantification of an alkane and oxygen using a single sensor. Examples of the method disclosed herein involve the electrochemical promotion of alkane oxidation and oxygen reduction/oxidation at an interface between a platinum or palladium electrode and an ionic liquid electrolyte (i.e., an organic salt that is a liquid at room temperature). In particular, the method(s) utilize alkyl substituted methylpyrrolidinium bis(trifluoromethylsulfonyl)imide ionic liquid electrolytes, or $[C_n mpy][NTf_2]$ (where n=2-10). Examples of these ionic liquids include 1-ethyl-1-methylpyrrolidinium bis(trifluoromethylsulfonyl)imide (i.e. $C_2mpy][NTf_2]$), 1-propyl-1-methylpyrrolidinium bis(trifluoromethylsulfonyl)imide (i.e. $C_3mpy][NTf_2]$), 1-butyl-1-methylpyrrolidinium bis(trifluoromethylsulfonyl)imide (i.e. $C_4mpy][NTf_2]$), 1-pentyl-1-methylpyrrolidinium bis(trifluoromethylsulfonyl)imide (i.e. $C_5mpy][NTf_2]$), 1-hexyl-1-methylpyrrolidinium bis(trifluoromethylsulfonyl)imide (i.e. $C_6mpy][NTf_2]$), 1-heptyl-1-methylpyrrolidinium bis(trifluoromethylsulfonyl)imide (i.e. $C_7mpy][NTf_2]$), 1-octyl-1-methylpyrrolidinium bis(trifluoromethylsulfonyl)imide (i.e. $C_8mpy][NTf_2]$), 1-nonyl-1-methylpyrrolidinium bis(trifluoromethylsulfonyl)imide (i.e., $C_9mpy][NTf_2]$), and 1-decyl-1-methylpyrrolidinium bis(trifluoromethylsulfonyl)imide (i.e., $C_{10}mpy][NTf_2]$), and combinations thereof. $[C_4mpy][NTf_2]$ is shown in FIG. 1. It is to be understood that the other ionic liquids have similar structures, except the butyl group is replaced with another alkane.

It is believed that the loosely-packed double layer formed in $[C_4mpy][NTf_2]$ and the other ionic liquids disclosed herein allows for facile alkane adsorption and subsequent alkane oxidation at the interface between the working electrode and ionic liquid. The double layer of the ionic liquid is formed by the arrangement of ion pairs at the electrode/electrolyte interface, which depends upon the electrode potential. Generally, the bulky ions of ionic liquids allow the formation of a much more flexible and less compact double layer, when compared to double layers formed in aqueous electrolytes. The double layer formed in the ionic liquids disclosed herein is particularly suitable for allowing small gas molecules to pass through to and to reach the electrode/electrolyte interface.

The ionic liquids used in the examples disclosed herein are also highly chemically inert and have relatively low gas solubility. These characteristics advantageously keep potentially interfering species, such as water vapor in the surrounding atmosphere (i.e., changing humidity), from interfering with the reactions taking place at the interface between the electrode and the ionic liquid.

It has been found that a distinctive electrochemically coupled reaction (i.e., an electrode reaction followed by a catalytic reaction) takes place in the ionic liquid at or near the electrode/electrolyte interface. This electrochemically coupled reaction is unique to the ionic liquids and is not supported by conventional electrolytes. This electrochemically coupled reaction involves i) the reduction of oxygen introduced into the system to form a reduced oxygen species, and then ii) a reaction between the reduced oxygen species and a reaction product of the previously performed alkane oxidation. The electrochemically coupled redox reaction facilitates the in situ depletion of the reaction product and regenerates oxygen.

It has also been found that changes in the oxygen concentration do not affect the signal intensity of the alkane (at least at low alkane concentration), and that the current or current density of oxygen species reduction is related to the square root of the concentration of the reaction product, which in turn is proportional to the current or current density of alkane oxidation. In the examples disclosed herein, these relationships have been exploited to develop an internal standard method in which the alkane is utilized to calibrate oxygen detection.

An internal standard is a substance that is added in a constant amount to all samples (e.g., blanks, calibration standards, samples) in an analysis. The calibration generally involves calculating the ratio of the signal from the analyte to the signal from the internal standard, and then plotting this ratio as a function of the analyte concentration. Generally, an internal standard is absent from the sample matrix. In the examples disclosed herein, at least one of the reaction products of alkane oxidation is absent from the sample matrix. As previously mentioned, this reaction product is also involved in the electrochemically coupled redox reaction with the oxygen species. It has been found that through this reaction product and through the relationship of the reaction product with both the current or current density of oxygen species reduction and the current or current density of alkane oxidation, the alkane may be used as the internal standard to calibrate oxygen detection/measurement.

The various reactions taking place in the examples of the method disclosed herein are localized near the interface between the working electrode and the ionic liquid electrolyte. Carbon dioxide present in the surrounding environment does not affect the alkane oxidation or the distinctive electrochemically coupled reaction taking place at the interface, at least in part because carbon dioxide has low solubility in the ionic liquid. As such, the in situ generated carbon dioxide resulting from alkane oxidation is the predominate carbon dioxide taking place in the reaction(s) at the interface. This renders the alkane (at least through its relationship with the in situ generated carbon dioxide/alkane oxidation product) a more suitable internal standard.

These unique, localized reactions enable the identification/detection and quantification of both the alkane and the oxygen. As such, the examples disclosed herein enable the detection and quantification of multiple analytes (e.g., the alkane and oxygen introduced into the system) using a single sensor that includes the ionic liquid. The addition of oxygen catalyzes the alkane oxidation and also provides an analyte to be measured. In the examples disclosed herein, the emission of any new gaseous species will lead to a reduction of oxygen concentration. Thus, a measure of oxygen concentration is an indicator for the emission or the presence of a new gaseous species. Thus the oxygen concentration may be used to cross-validate the measurement of the alkane. This will aid in eliminating false positives and false negatives by cross-validating the measurement results.

The method(s) disclosed herein may advantageously be achieved at room temperature (i.e., at a temperature ranging from about 18° C. to about 30° C.). It is believed, however, that the method(s) disclosed herein may be performed in any temperature up to 200° C., based, at least in part, upon the thermal stability of the ionic liquid used. Performing the method at or near room temperature may be particularly desirable, for example, for electrocatalysis applications, for harnessing methane for energy storage, conversion or synthesis, for making methane-based fuel cells, and/or for developing methane sensors (e.g., for monitoring methane in mining, domestic gas supplies, etc.). As such, it is believed that the method(s) disclosed herein may be used in a variety of applications.

Figure 2A:
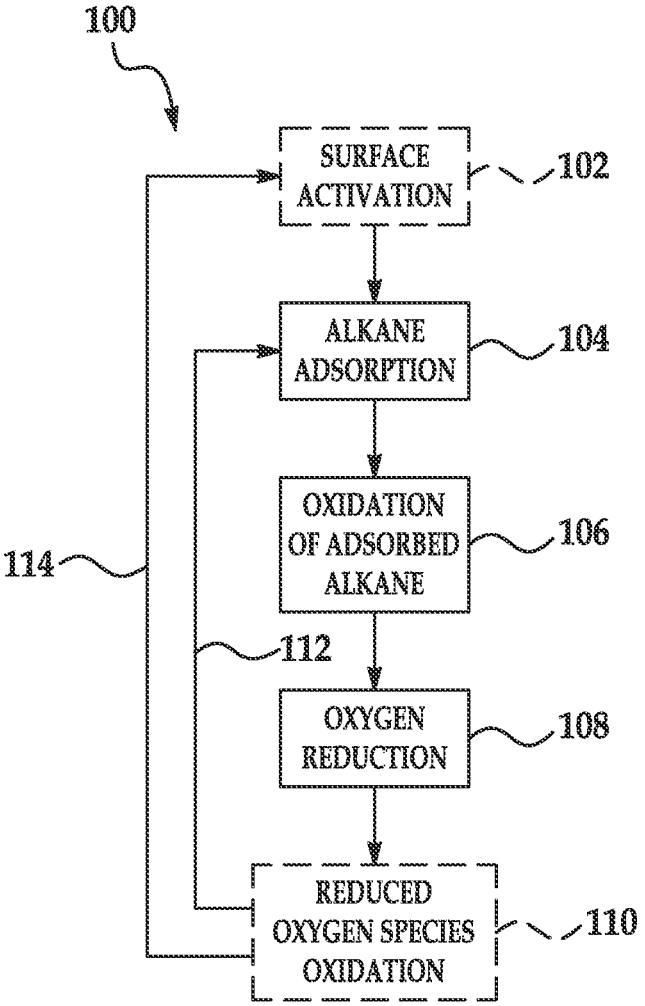
FIG. 2A is a flow diagram illustrating an example of an alkane oxidation and oxygen reduction method.

Referring now to FIG. 2A, an example of the chemical processes taking place during an example of the method is generally shown at reference numeral 100. At the outset, an interface between the ionic liquid and the platinum or palladium working electrode is exposed to an activation or cleaning process (reference numeral 102). In some examples, the activation or cleaning process 102 may be performed a single time followed by multiple cycles (denoted by arrow 112) of alkane adsorption 102, alkane oxidation 104, oxygen reduction 106, and reduced oxygen species reoxidation 108. This may be suitable, for example, when the reactions taking place at the interface are reversible or semi-reversible. In other examples, the activation or cleaning process 102 may be performed prior to each use of the sensor (denoted by arrow 114). In still other examples, if the working electrode had been previously activated or cleaned, the activation or cleaning process 102 may be skipped.

When working electrode activation or cleaning 102 is performed, it may involve the application of a sufficient oxidative (positive) and/or reductive (negative) bias voltage for a certain time. As an example, the activation process may include exposing the interface to oxygen (either pure oxygen or an oxygen-containing gas) and a first electrode potential (which is positive), which oxidizes at least a portion of the working electrode surface. The activation may alternatively or additionally include applying a negative potential, thereby exposing the interface to a reduction process where the oxygen is removed. One or more cycles of oxidation and reduction may be performed, depending upon the type of electrode that is used.

At step 104, an alkane is adsorbed at or near the interface between the working electrode and the ionic liquid. In an example, this is accomplished by exposing the interface to an alkane (in the absence of oxygen) and applying, to the platinum or palladium working electrode, a negative potential. This step may also be performed without the application of the negative electrode potential (i.e., no potential is applied or an open circuit potential is applied). In general, the alkane adsorption may be facilitated by applying potential or no potential based on an optimum alkane adsorption potential window.

This example of the method also includes step 106, which involves exposing the interface to the alkane and to oxygen and applying, to the platinum or palladium working electrode, another electrode potential. This electrode potential may be more positive than the potential used for surface activation or cleaning 102 and the potential used for alkane adsorption 104. It is believed that this step 106 results in the oxidation of the adsorbed alkane.

At step 108, oxygen reduction takes place. This may be performed by exposing the interface to oxygen and applying, to the platinum or palladium working electrode, yet another electrode potential that is negative. In this example, the electrode potential may be more negative than any of the other electrode potentials previously applied. In an example, this negative electrode potential may be any negative potential that is equal to or more negative than −1.2 V. As briefly mentioned above, it is believed that this step 108 reduces oxygen that is introduced into the system and is present at or near the interface. Oxygen reduction forms a reduced oxygen species.

The reduced oxygen species is capable of reacting immediately with the previously formed alkane oxidation reaction product, e.g., carbon dioxide. This reaction regenerates oxygen, as shown at reference numeral 110.

It is to be understood that the method 100 may also involve the application of yet another potential, which is more positive than the most recently applied negative potential (i.e., the potential applied at step 108). This additional potential may simply be a switch back to the positive electrode potential. This causes the oxidation of any alkane that may be present at the interface and the generation of additional alkane oxidation reaction product.

It is to be understood that other examples of the method (not shown) may first involve alkane adsorption (at a first electrode potential), followed by simultaneous working electrode activation and alkane oxidation (at a second potential that is more positive than the first electrode potential). These examples of the method may continue with oxygen reduction 108 and reduced oxygen species oxidation 110 as previously described through application of suitable potentials and in the presence of oxygen.

In each of the example methods, it is to be understood that the working electrode surface activation may be performed in the presence of some alkanes (e.g., methane), but should be performed in the absence of other alkanes (e.g., pentane and hexane). This may be due to the fact that some alkanes (e.g., pentane and hexane) are more readily oxidizable than other alkanes (e.g., methane). As an example, if platinum surface activation is performed in the presence of pentane or hexane, multiple undesirable products (e.g., soluble non-gas product(s) that may contaminate the system) may be formed. As such, examples of the method may not be suitable for easily oxidizable alkanes, such as pentane and hexane, when working electrode surface activation takes place while the surface is exposed to the alkane. This process may be suitable for methane, at least in part because even if it is oxidized at this point, the products can be purged from the system or utilized for subsequent reaction with the reduced oxygen species that is generated. For the easily oxidizable alkanes, the platinum or palladium activation process may be performed in oxygen conditions without the presence of the alkane.

Figure 2B:
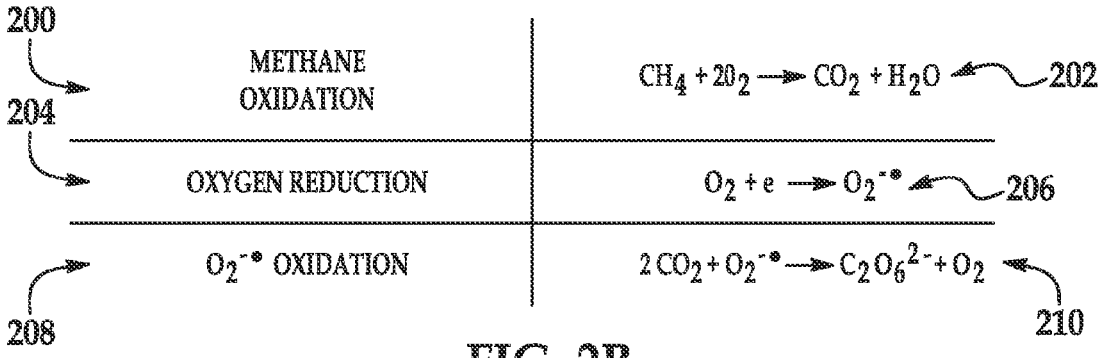
FIG. 2B is a table illustrating a flow diagram of an example of the method involving methane oxidation, oxygen reduction and oxygen regeneration, and the proposed chemical reaction mechanism that takes place at the various steps of the method.

Referring now to FIG. 2B, the chemical processes of methane oxidation, oxygen reduction, and reduced oxygen species oxidation are schematically depicted on the left hand side of the figure, and the proposed chemical mechanisms for these chemical processes are depicted on the right hand side of the figure. It is believed that the methods shown in FIGS. 2A and 2B may be used for a variety of alkanes, including methane, pentane, hexane, or any other alkane. However, as noted above, examples of the method that perform platinum surface activation in the absence of the alkane are suitable for those alkanes that are more readily oxidizable. When liquid alkanes (e.g., pentane or hexane) are utilized, it is to be understood that a gas feeding system may be utilized to purge the vapors in order to perform the method. Furthermore, the reaction product(s) may vary depending upon the alkane that is selected.

In general and as outlined in FIG. 2A, the methods disclosed herein involve the adsorption of the alkane at or near the activated electrode, the subsequent oxidation of the adsorbed alkane, and the reduction of oxygen. As briefly mentioned above, in some examples of the method, the reduced oxygen species may be oxidized by the alkane oxidation reaction product (e.g., carbon dioxide, $CO_2$) to regenerate oxygen. $CO_2$ can react readily with the reduced oxygen species. This immediate reaction between the $CO_2$ and the reduced oxygen species may keep water (another product of alkane oxidation) from reacting with the reduced oxygen species. Too much $CO_2$ present at the electrode/ionic liquid interface can generate carbon monoxide (CO), which can poison the platinum electrode and lower the rate of subsequent alkane adsorption and oxidation. By enabling the reaction of $CO_2$ with the reduced oxygen species according to the examples disclosed herein, not only is reactant oxygen regenerated, but the $CO_2$ is in situ depleted from the system.

As will be discussed further herein, it is believed that the electrode activation, the alkane adsorption, the subsequent alkane oxidation, and the oxygen reduction take place at different applied potentials. In some instances, alkane adsorption may even take place without any applied potential. As such, any suitable technique involving changing electrode interface potentials may be utilized. As examples, cyclic voltammetry, chronoamperometry, or any other techniques involving a potential sweep or step may be utilized.

Figure 3A:
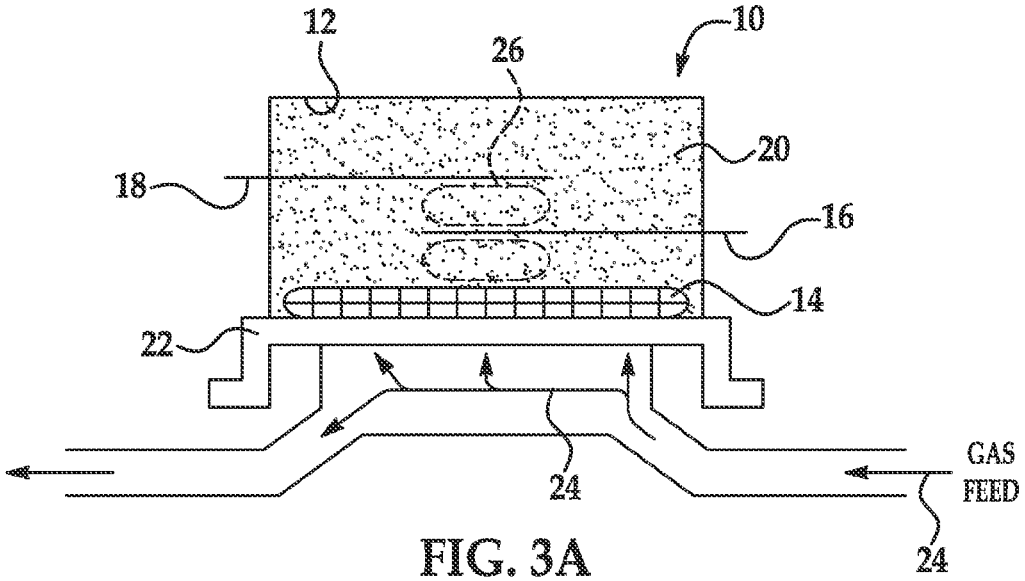
FIG. 3A is a cross-sectional schematic illustration of an electrochemical sensor (similar to system 1 described further herein) that may be used to perform an example of the method disclosed herein, where the sensor includes a macroelectrode.

Referring briefly to FIG. 3A, an example of a system 10 that may be used to perform the method(s) is schematically depicted. The system 10 may include a cell 12 that contains the electrodes (i.e., the platinum or palladium working electrode 14, a reference or quasi-reference electrode 16, and a counter electrode 18) and the ionic liquid 20 in contact with each of the electrodes 14, 16, 18. Examples of suitable reference and counter electrodes 16, 18 include polycrystalline platinum wires or meshes. Another example of the reference electrode 16 is a quasi-platinum reference electrode. An example of the platinum working electrode 14 is a mesh platinum gauze. This type of electrode 14 allows for efficient current collection with excellent gas diffusivity. In another example, the working electrode 14 and the counter electrode 18 may be formed as an interdigitated electrode (discussed further in reference to FIG. 3B), and the reference electrode 16 may be placed along the working electrode 14. In the example shown in FIG. 3A, the platinum working electrode 14 may be a solid macroelectrode. The macroelectrode may have a diameter that is equal to or greater than 1 mm.

In some examples, a traditional sputtered platinum or platinum black electrode may not be suitable for the method or system (e.g., a reusable electrode) disclosed herein, at least in part because it can be deactivated in the presence of oxygen (i.e., platinum black has a tendency to strongly adsorb $CO_2$ which can deactivate the platinum surface). As such, a platinum black electrode may be more suitable for use as a limited-lifetime electrode that operates according to the method(s) disclosed herein, or it may be more suitable for examples of the method where the $CO_2$ is reacted with a reduced oxygen species to regenerate oxygen.

The electrodes 14, 16, 18 may be separated by a porous cellulose spacer 26.

In the example shown in FIG. 3A, the platinum working electrode 14 is pressed onto a porous gas-permeable membrane 22 which physically separates the interior of the cell 12 from a gas feed 24. In an example, the porous gas-permeable membrane 22 is polytetrafluoroethylene (an example of which is TEFLON® from Dupont).

One or more gases are fed through the gas feed 24. The gases permeate through the porous gas-permeable membrane 22 into the cell 12 where they participate in the various steps of the method(s) disclosed herein.

It is believed that the system 10 shown in FIG. 3A may be miniaturized and integrated into a wearable sensor. In an example, the sensor could be programmed to perform a double step chronoamperometry method for alkane oxidation and oxygen reduction and re-oxidation.

Figure 3B:
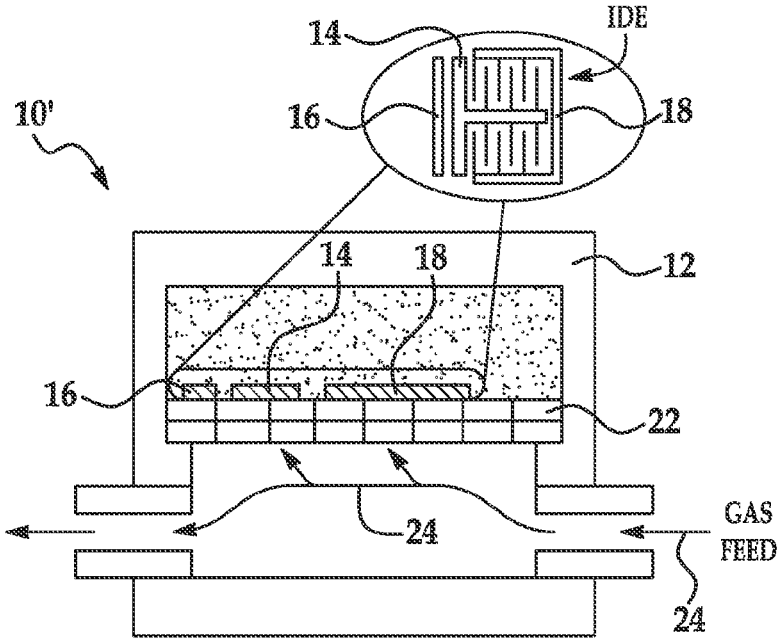
FIG. 3B is a cross-sectional schematic illustration of another electrochemical sensor (similar to system 2 described further herein) that may be used to perform an example of the method disclosed herein, where the sensor includes an interdigitated electrode, which is shown from a top view in the inset.

Referring briefly to FIG. 3B, another example of a system 10' that may be used to perform the method(s) is schematically depicted. The system 10' may include the cell 12, which in this example contains the working electrode 14 and the counter electrode 18 as an interdigitated electrode IDE (a top schematic view of which is shown in the inset of FIG. 3B), and the reference or quasi-reference electrode 16 positioned along the working electrode portion 14 of the interdigitated electrode IDE. As shown in FIG. 3B, the system 10' also includes the ionic liquid 20 in contact with each of the electrodes 14, 16, 18.

The interdigitated electrode IDE may be a microfabricated planar electrode that is printed, vapor deposited, or made using some other suitable microfabrication technique. As such, the interdigitated electrode IDE may be very thin and may as flexible as the substrate upon which it is fabricated. In the example shown in FIG. 3B, the IDE is fabricated directly on the porous gas-permeable membrane 22.

The width and the gap between the counter electrode 18 and working electrode 14 fingers of the interdigitated electrode IDE may be anywhere from about 150 μm to about 150 μm. The thickness of the IDE may range from about 400 nm to about 600 nm. These dimensions are believed to ensure good continuity of the thin film IDE without blocking the pores of the membrane 22.

One or more gases are fed through the gas feed 24. The gases permeate through the porous gas-permeable membrane 22 into the cell 12 where they participate in the various steps of the method(s) disclosed herein.

While not shown, it is to be understood that the system 10' may include O-rings or other mechanical components that will aid in clamping or otherwise securing the interdigitated electrode IDE so that the gas flow, gas concentration, etc. can be readily controlled.

It is believed that the system 10' shown in FIG. 3B may also be miniaturized and integrated into a wearable sensor. In an example, the sensor could be programmed to perform a double step chronoamperometry method for alkane oxidation and oxygen reduction and re-oxidation.

Referring back to FIG. 2B, all of the reactions shown at reference numerals 202, 206, and 210 are believed to take place at the surface of the platinum or palladium working electrode 14.

While not shown in FIG. 2B, the method includes supplying an alkane gas in the presence of oxygen to the interface between the $[C_n mpy][NTf_2]$ ionic liquid 20 and the activated surface of the platinum working electrode 14. The supplied gas may be, as examples, methane gas in the presence of an oxygen-containing gas, or pentane vapors in the presence of an oxygen-containing gas, or hexane vapors in the presence of an oxygen-containing gas, or any other alkane gas/vapor in the presence of an oxygen-containing gas. When a combination of the alkane gas and the oxygen-containing gas is utilized, the ratio of alkane gas to oxygen-containing gas may range anywhere from 1% alkane gas: 99% pure oxygen gas to 90% alkane gas: 10% pure oxygen gas. When air is utilized as the oxygen-containing gas, air contains about 20% oxygen. In these instances, the percentage of air utilized may vary depending on the desired amount of oxygen to be supplied.

The alkane that is supplied to the interface in the presence of oxygen adsorbs at or near the interface at the surface of the activated platinum working electrode 14. Adsorption of the alkane may be more favorable when no potential is applied or when a particular potential is applied to the working electrode 14. As such, during alkane adsorption, the application of a potential and the value of any applied potential may vary depending upon the properties of the alkane being used.

In some instances, no potential is applied while the alkane gas (either alone or in combination with the oxygen-containing gas) is supplied to the interface. In these instances, an open circuit potential may be used. In this example, physical adsorption of the methane or other alkane occurs.

A suitable potential may be applied that assists in facilitating alkane adsorption. For example, a negative potential or a potential that is more negative than the other applied potential(s) is applied to the working electrode 14 while the alkane gas (either alone or in combination with the oxygen-containing gas) is supplied to the interface. When a potential is applied while the alkane gas is supplied to the interface, the optimum potential for alkane adsorption may be obtained, for example, by cyclic voltammetry.

While alkane adsorption may take place in the presence of the oxygen-containing gas, it is to be understood that alkane adsorption may also take place in the absence of the oxygen-containing gas. As such, some examples of the method disclosed herein include a step of supplying the alkane gas to the interface in the absence of oxygen while simultaneously applying no electrode potential or the negative electrode potential (depending upon the alkane being used) to the working electrode 14. This step may be performed, for example, during a first cycle of the method in order to initiate the absorption of the alkane at or near the interface. In this example, during subsequent cycles, the mixture of the alkane gas and the oxygen-containing gas may be supplied to the interface to introduce additional alkanes.

After alkane adsorption takes place, a positive electrode potential may be applied to the working electrode 14 while the alkane gas in the presence of the oxygen-containing gas is supplied to the interface. This is believed to initiate oxidation of the adsorbed alkanes (as shown at reference numeral 200 in FIG. 2B). In an example, the alkane oxidation potential may be higher than 0.7 V.

As noted above, during the application of the positive electrode potential, oxidation of the adsorbed alkane takes place. As shown at reference numeral 202 in FIG. 2B, an oxygen species (shown as $O_2$) reacts with methane ($CH_4$) to form carbon dioxide ($CO_2$) and water ($H_2O$). Without being bound to any theory, the oxygen species may be a reactive oxygen species that catalyzes the alkane oxidation. The following is one example of what may be occurring at the interface. Upon application of the positive electrode potential, an oxygen containing platinum adsorbate forms and bonds with ionic liquid anions (i.e., $NTf_2^-$). This adsorbate can be further oxidized to form an interface complex at the interface, which contains the reactive oxygen species at the surface of the platinum working electrode 14. The interface complex on the platinum surface then reacts with the alkane to break the C—H bonds and form suitable reaction products. When the alkane is methane, the reaction between the methane and the interface complex results in the formation of carbon dioxide and water (again reference numeral 202 in FIG. 2B). Reference numeral 202 illustrates the overall reaction for methane oxidation.

The positive electrode potential applied to initiate oxidation of the adsorbed alkane may depend upon the alkane used.

The alkane concentration may be determined using an alkane anodic current ($i_{CH4\text{-}anodic}$) or an alkane anodic current density ($j_{CH4\text{-}anodic}$). The alkane anodic current ($i_{CH4\text{-}anodic}$) is the current observed/measured when alkane oxidation takes place. The alkane anodic current density ($j_{CH4\text{-}anodic}$) is the current observed/measured when alkane oxidation takes place normalized by the area of the working electrode 14 that is used. A linear relationship has been observed between peak currents and known alkane concentrations (e.g., from 0% methane to 10% methane), and thus any unknown alkane concentration can be quantified using the alkane anodic current ($i_{CH4\text{-}anodic}$) or the alkane anodic current density ($j_{CH4\text{-}anodic}$) and linear regression fitting. The slope of the line from linear regression fitting represents the sensitivity of the current or current density toward the methane concentration. The linear equation can then be used to determine the methane concentration in an unknown sample. In particular, the linear fit of the current/current density signal versus the analyte concentration may be used to determine the unknown analyte concentration because the signal can be measured.

Some of the reaction products of alkane oxidation may be removed from the system 10, and some other of the reaction products of alkane oxidation may remain in the system 10 to be used in reaction(s) during subsequent cycles. The water product, which separates from the hydrophobic ionic liquid, may be removed from the system 10 by air flowing above the cell 12. Minimal (i.e., trace) amounts of water may remain in the system 10 as it is believed that these amounts do not change the methane oxidation process. It is believed that this is also due to the hydrophobicity of the $[C_4mpy][NTf_2]$ ionic liquid 20. While the oxidation of water in the $[C_4mpy][NTf_2]$ ionic liquid 20 is thermodynamically feasible, the process is kinetically slow and thus the reaction is expected to proceed between the interface complex (which contains the reactive oxygen species) and the adsorbed methane.

In the examples of the method disclosed herein, the carbon dioxide reaction product (from alkane oxidation) remains in the system 10 for reaction with a reduced oxygen species. Prior to the reaction between the carbon dioxide reaction product and the reduced oxygen species, the reduced oxygen species is first generated in the system 10. Oxygen reduction (i.e., generation of the reduced oxygen species) is shown at reference numerals 204 and 206 of FIG. 2B.

The oxygen that is reduced is the oxygen that is introduced into the system 10 (i.e., as pure oxygen gas or as air). After alkane oxidation has taken place, the application of another negative electrode potential to the platinum working electrode 14 reduces the oxygen species at or near the interface to form a reduced oxygen species. This reduction reaction is shown at reference numeral 206 in FIG. 2B as $O_2+e\rightarrow O_2.^-$. As discussed above, the negative voltage suitable for reducing the oxygen species may be at or more negative than −1.2 V (at least when a platinum quasi-reference electrode is used).

This reduced oxygen species, $O_2.^-$, is very reactive and is capable of forming ion-pairs with the ionic liquid cations (e.g., the $[C_nmpy]^+$ cations), is capable of reacting with water (i.e., the other alkane oxidation reaction product), and is also capable of reacting with the carbon dioxide reaction product. All of the carbon-hydrogen bonds in the $[C_nmpy]^+$ cations are saturated, and thus are relatively chemically inert. Therefore, the reduced oxygen species does not react with the ionic liquid cations. The reaction of water with the reduced oxygen species is thermodynamically feasible but is kinetically slow. In contrast, the reaction between carbon dioxide and the reduced oxygen species is very fast, and thus the carbon dioxide that is generated from alkane oxidation reacts immediately with the reduced oxygen species. The reduced oxygen species is quickly consumed through the reaction with the carbon dioxide, so that the amount, if any, of reduced oxygen species remaining at the interface is minimal. This reduces the possibility of the reduced oxygen species reacting with ionic liquid cations or with the water reaction product. The reaction between the reduced oxygen species and the carbon dioxide oxidizes the reduced oxygen species, $O_2.^-$, to regenerate oxygen, as shown at reference numerals 208 and 210 in FIG. 2B ($2CO_2+2O_2.^-\rightarrow C_2O_6^{2-}+O_2$). The regenerated oxygen can be fed back to the oxygen reduction reaction (reference numeral 206).

To reiterate from above, the oxygen reduction reaction is $O_2+e\rightarrow O_2.^-$. It has been found that the current of this reaction (i.e., $i_{O2\text{-}cathodic}$ or oxygen cathodic current) and the current density of this reaction (i.e., $j_{O2\text{-}cathodic}$ or oxygen cathodic current density) are related to both the oxygen concentration and the square root of the concentration of the carbon dioxide reaction product by the following equations:

$$i_{O2-cathodic} = \frac{nFAC^*_{O2}(Dk'C^*_{CO2})^{1/2}}{1+\exp\left[\frac{nF}{RT}(E-E_{1/2})\right]}$$

-continued $$j_{O2-cathodic} = \frac{nFC^*_{O2}(Dk'C^*_{CO2})^{1/2}}{1+\exp\left[\frac{nF}{RT}(E-E_{1/2})\right]}$$

where n is the number of electrons transferred in the electrochemical reaction $O_2+e \rightarrow O_2.^-$ (and thus n=1), F is Faraday constant (i.e., $9.64853399(24)\times10^4$ C·mnol$^{-1}$), A (in the current equation) is the electrode surface area, D is the diffusion coefficient, C* is the concentration of the noted gas (i.e., $O_2$ or $CO_2$) in the liquid phase, k' is the rate constant of the oxygen regeneration reaction (i.e., $(2CO_2+2O_2.^- \rightarrow C_2O_6^{2-}+O_2)$, and E is the electrode potential. The concentration of the carbon dioxide reaction product (i.e., $C^*_{CO2}$) is also proportional to the alkane anodic current ($i_{CH4\text{-}anodic}$) and the alkane anodic current density ($j_{CH4\text{-}anodic}$). It has been found that the relationships between the current ($i_{O2\text{-}cathodic}$) of the oxygen reduction reaction, the oxygen concentration, the square root of the concentration of the carbon dioxide reaction product, and the alkane anodic current ($i_{CH4\text{-}anodic}$) or current density ($j_{CH4\text{-}anodic}$) enable the alkane to be used as an internal standard for determining the oxygen concentration.

The oxygen reduction currents and current densities do not follow a linear relationship with oxygen concentration. In the examples of the internal standard method disclosed herein, however, it has been found that the oxygen reduction currents or current densities can be normalized using the square root of the alkane anodic current (i.e., $(i_{CH4\text{-}anodic})^{1/2}$), and that these normalized values do follow a linear relationship with both oxygen concentration and alkane concentration. Table 1 illustrates the various examples of the normalization equations that may be used for the oxygen reduction currents and current densities.

TABLE 1

| Current/Current Density to be normalized | Normalization Equation |
|---|---|
| Oxygen reduction (cathodic) current (i.e., $i_{O2\text{-}cathodic}$) | $i_{O2\text{-}cathodic\ normalized} = \lvert i_{O2\text{-}cathodic}\rvert/\sqrt{i_{CH4\text{-}anodic}}$ |
| Oxygen reduction (cathodic) current density (i.e., $j_{O2\text{-}cathodic}$) | $j_{O2\text{-}cathodic\ normalized} = \lvert j_{O2\text{-}cathodic}\rvert/\sqrt{j_{CH4\text{-}anodic}}$ |

The normalized products may be referred to herein, respectively, as the normalized oxygen cathodic current value and the normalized oxygen cathodic current density value.

These normalized values may be plotted as a function of either the alkane concentration or the oxygen concentration (i.e., the known amount input into the system 10) to generate a calibration curve. Linear regression fitting may be used to determine the slope and intercept of the calibration curve, and the slope of this line represents the sensitivity of the normalized current or current density towards the alkane or oxygen concentration. As such, the linear equation can used to determine the oxygen concentration.

In one example of the method, different potentials are applied to achieve the platinum working electrode surface activation, the alkane adsorption, and then the alkane oxidation. For example, surface activation may take place at about 0.7 V (in the presence of supplied oxygen), alkane (e.g., methane) adsorption may take place at about −0.3 V (in the presence of supplied alkane without oxygen), while alkane (e.g., methane) oxidation takes place at about 0.9 V (in the presence of both the supplied alkane and oxygen). Each of these potentials are suitable for the noted supplied gas and using the $[C_4mpy][NTf_2]$ ionic liquid. The potentials may be different, for example, if a different ionic liquid is used, if a different alkane is used, and/or if the gases are supplied simultaneously throughout the process.

In this same example of the method, the oxygen-containing gas may continue to be supplied in order to achieve oxygen reduction and reduced oxygen species oxidation. In this example, a potential is applied to first achieve the oxygen reduction, and then the oxidation of the reduced oxygen species occurs almost immediately as long as the alkane oxidation product is present in the system. For example, oxygen reduction may take place at about −1.2 V. In an example, reduced oxygen species (e.g., $O_2.^-$) oxidation is seen as taking place at about −0.7 V during a potential sweep or step back to a positive potential that will cause alkane oxidation. The potentials may be different, for example, if a different ionic liquid and/or a different alkane is used.

In ionic liquid electrolytes, the previously mentioned unique double layer is formed that has three structurally distinct regions: an interfacial (innermost) layer composed of ions in direct contact with the electrode; a transition region over which the pronounced interfacial layer structure decays to the bulk morphology; and a bulk liquid region where structure depends on the degree of ion amphiphilicity. Slow scan rates may result in the reorientation of the ionic liquid. It is believed that this deleterious effect may be by-passed using high scan rates (i.e., 500 mV/s). As such, higher scan rates minimize the hysteresis of the ionic liquid double layer. It is further believed that this scan rate provides a balance between signals ($i_{ps}/i_{dl}$), where $i_{ps}$ is the peak current resulting from the faradic process (i.e., the process of the species involving electron transfer) and $i_{dl}$, is the double layer charging current. The higher the $i_{ps}/i_{dl}$ ratio, the better the sensitivity for sensor application, as the double layer charging current is not analyte specific and may be considered to be a noise signal.

Furthermore, multiple cycles may be used to condition the electrode-ionic liquid interface to reach a steady state of the ionic liquid electrode double layer.

It is to be understood that in the methods disclosed herein, the actual potentials applied may vary, at least in part, on the concentration of the alkane gas and/or oxygen-containing gas that is/are supplied to the system 10. Furthermore, the potentials disclosed herein are versus a platinum quasi-reference electrode, and it is to be understood that the potentials may be shifted if another reference electrode is utilized.

To further illustrate the present disclosure, examples are given herein. It is to be understood that these examples are provided for illustrative purposes and are not to be construed as limiting the scope of the disclosed example(s).

EXAMPLES

The ionic liquid (i.e., 1-butyl-1-methylpyrrolidinium bis (trifluoromethylsulfonyl)imide ($[C_4mpy][NTf_2]$) used in the Examples disclosed herein was prepared by standard literature procedures. The physical properties are reported in Table 2 below.

TABLE 2

| Ionic Liquid | η (at 25° C.) mPs s | Λ S m$^{-1}$ | d g cm$^{-3}$ | $V_m$ cm$^3$ mol$^{-1}$ | Potential Window V |
|---|---|---|---|---|---|
| ($[C_4mpy][NTf_2]$) | 76, 56 | 0.29 | 1.41 | 317 | −3.0 to +3.0 |

η is the viscosity;
Λ is the conductivity;
d is the mass density (±1%).
$V_m$ is the molar volume (±1%).

System 1, similar to that shown in FIG. 3, was used, in part, to show that the methane oxidation reaction and the electrochemically coupled oxygen redox reactions are specific. The working electrode was a 100-mesh Pt gauze (with an area of 0.64 $cm^2$) that was pressed onto a porous, gas-permeable PTFE membrane (ZITEX™, Chemplast, Inc., NJ). The quasi-reference and counter electrodes were 0.5-mm diameter polycrystalline Pt wires (Sigma-Aldrich, St. Louis, Mo.). The three electrodes were organized into a sandwich-type structure as shown in FIG. 3 within a Kel-F electrochemical cell.

The electrochemical cell of System 2 was similar to System 1, except that a flexible interdigitated electrode (IDE) was used as the working electrode and counter electrode. This IDE was a microfabricated planar Pt electrode, which was vapor deposited on the same type of gas-permeable PTFE membrane used in System 1. In this example, a quasi-reference electrode was also vapor deposited along the working electrode portion of the IDE. The finger width and the gap between the counter electrode and working electrode of the IDE were each 200 μm. The thickness of the platinum was 500 nm, which ensured good continuity of the thin film without blocking the pores of the membrane. The electrodes were coated with 200 μm of the ionic liquid $[C_4mpy][NTf_2]$.

High purity (99.99%) gases (i.e., air, nitrogen, methane, carbon dioxide, $NO_2$, NO, and $SO_2$) from Airgas Great Lakes (Independence, Ohio) were used. The dry air had the following composition: 78% nitrogen, 21% oxygen, 0.03% $CO_2$, 0.93% Ar and less than 0.03% of various other components. In the Examples, the total pressure was kept constant. For example, if the amount of methane introduced was 1%, then 99% of air is used as the oxygen source. As such, the higher the methane concentration, the lower the oxygen (and air) concentration.

For each of systems 1 and 2, PTFE tubing was used for the gas feeding system. The tail gases were absorbed by an alkali solution (NaOH and $Ca(OH)_2$). Before every measurement, dry air was purged into the electrochemical system to remove water, $CO_2$ and residual unreacted methane until a cyclic voltammetry curve was obtained as the original dry air condition, and then the electrochemical experiments were carried out at a new methane concentration.

The total gas flow was controlled at 200 sccm by digital mass-flow controllers (MKS Instruments Inc). Any mixed gases were made by pre-mixing various gases in a glass bottle with a stirring fan before introducing them in the sensor system. Humidified gas streams were achieved by directing nitrogen gas at a desirable flow rate through a Dreschel bottle (250 mL) partially filled with water prior to mixing with the gas analytes.

The Examples were carried out at a temperature of 25±1° C.

The characterization of the electrochemical methane sensors (systems 1 and 2) were performed with a VersasStatMC (Princeton AMETEK US). All potentials were referenced to the platinum quasi-reference electrode potential which had been calibrated with ferrocene/ferrocenium (1 mM Fc/Fc+) redox processes in the same ionic liquid. All potentials were subsequently referenced with an error bar within ±5 mV.

Figure 4A:
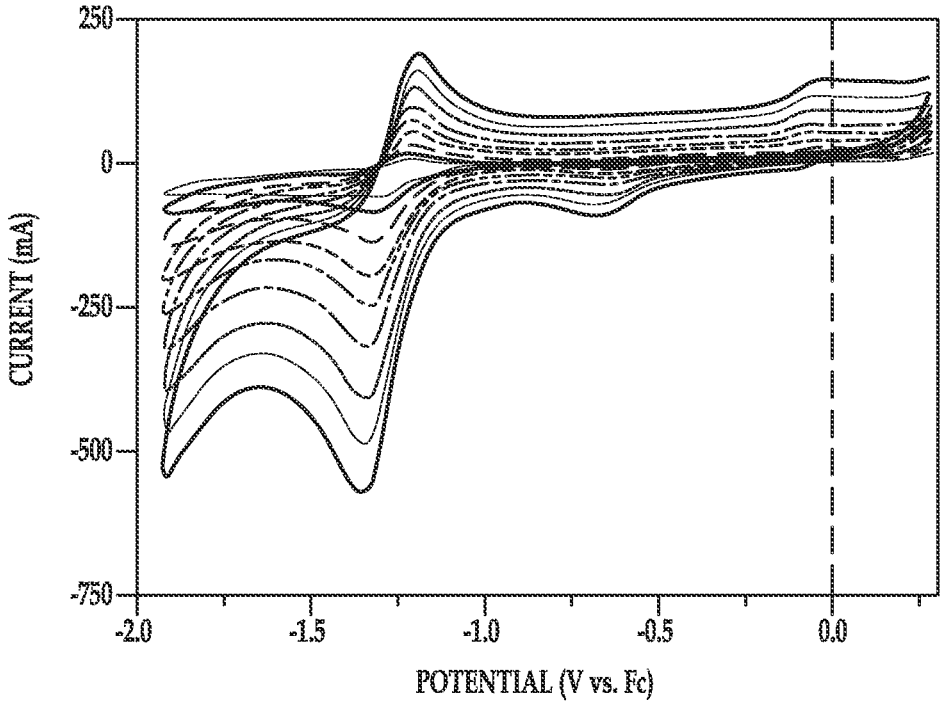
FIG. 4A depicts potential calibration of cyclic voltammograms in air in system 1, including 1-butyl-1-methylpyrrolidinium bis(trifluoromethylsulfonyl)imide (i.e., $[C_4mpy][NTf_2]$) as the ionic liquid electrolyte and a platinum gauze macroelectrode, the oxygen redox process was calibrated by a ferrocene probe at various scan rates.

FIG. 4A illustrates the characterization cyclic voltammetry (CV) curve for system 1 in air. As noted above, the oxygen redox process was calibrated by a ferrocene probe. Different scan rates were used. The currents observed, from highest to lowest, were at the following scan rates: 1000 mV/s, 800 mV/s, 600 mV/s, 500 mV/s, 300 mV/s, 200 mV/s, 100 mV/s, 50 mV/s, 20 mV/s mV/s. As depicted, in $[C_4mpy][NTf_2]$, the oxygen redox potentials were constant at different scan rates.

Figure 4B:
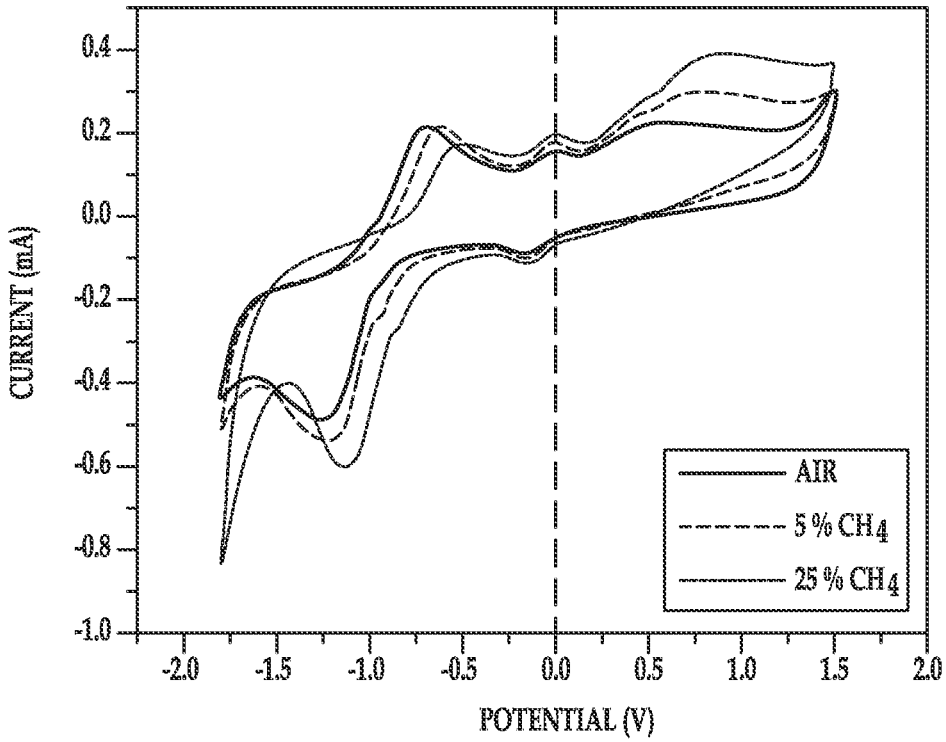
FIG. 4B depicts the cyclic voltammograms for system 1 used to generate FIG. 4A, with different methane concentrations introduced.

FIG. 4B illustrates the characterization cyclic voltammetry (CV) curve for system 1 in air and with 5% and 25% methane introduced. As noted above, the oxygen redox process was calibrated by a ferrocene probe.

Cyclic Voltammetry

Figure 5A:
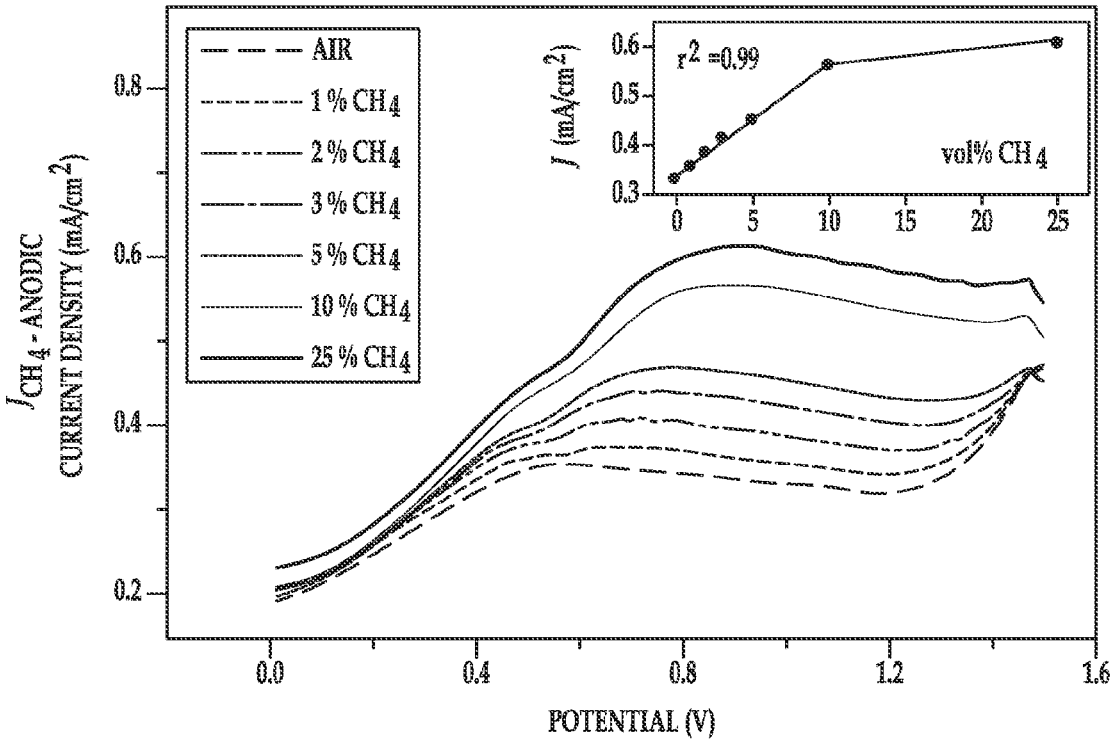
FIG. 5A is a graph depicting the anodic current density versus potential for different methane concentrations supplied to system 1, where the inset is the plot of the peak current density at 0.9 V versus the vol. % of methane.
Figure 5B:
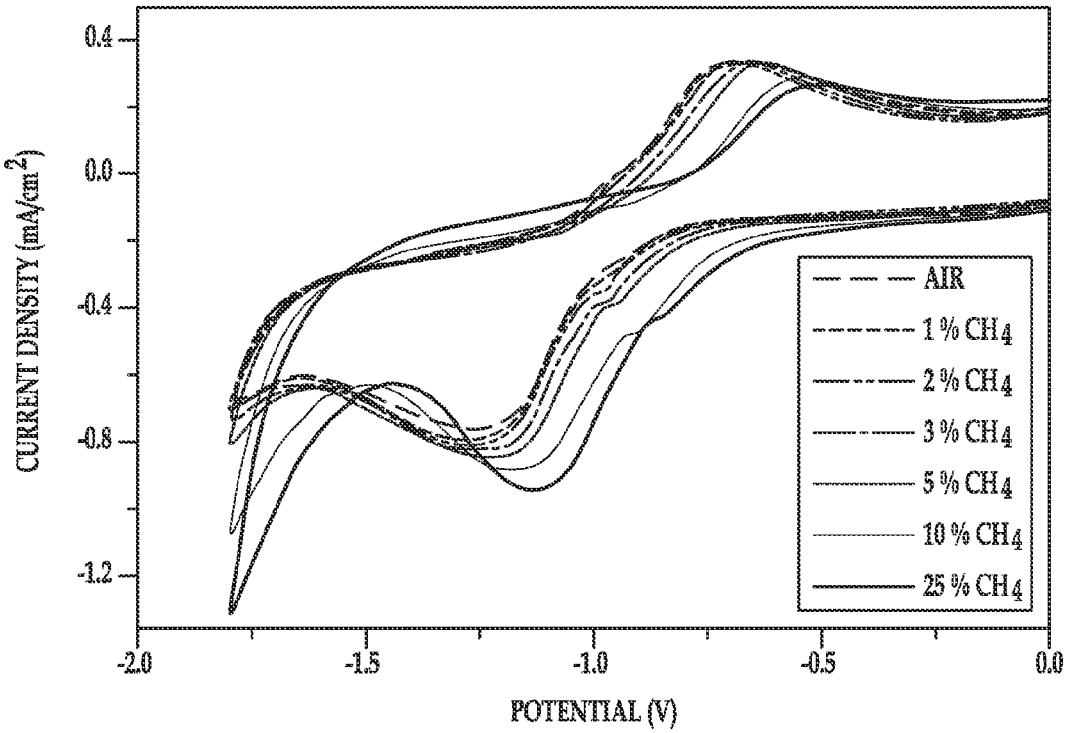
FIG. 5B depicts the cyclic voltammograms at the oxygen reduction potential window for different methane concentrations supplied to system 1.

System 1 including the $[C_4mpy][NTf_2]$ ionic liquid was exposed to cyclic voltammetry in air (i.e., 0 vol. % methane) and in one or more mixtures of air and methane (i.e., 1 vol. % methane in air, 2 vol. % methane in air, 3 vol. % methane in air, 5 vol. % methane in air, 10 vol. % methane in air, and 25 vol. % methane in air). The scan rate was 500 $mVs^{-1}$. FIG. 5A depicts the methane anodic current (i.e., methane oxidation) curves with the inset plot depicting the peak current at 0.9 V against the vol. % of methane. FIG. 5B depicts the voltammograms at the oxygen reduction potential window.

In FIG. 5A, the peaks of platinum activation were observed at around 0.5 V (before the methane oxidation peak at 0.8 V to 1.0 V), and the peak potential of activation was not affected by the presence of methane concentrations.

The inset in FIG. 5A shows that the anodic peak currents at about 0.9 V increases with methane concentration in a linear fashion. These results confirm that the response of voltammetry signal in $[C_4mpy][NTf_2]$ is primarily dependent on the concentration of methane available at the gas/ionic liquid electrolyte/Pt electrode three-phase boundary (TPB). From 0 vol. % to 10 vol. %, the methane sensitivity was 22.7 $mA/cm^2\%$, while the sensitivity dropped at the higher methane concentration. The stoichiometric ratio of methane to oxygen is 1:2. Air (containing a maximum of 21% oxygen) was used as the background gas. When the methane concentration was higher than 10.5 vol. %, the methane oxidation process was limited by the oxygen concentration and the slope of sensitivity was changed. Using the results in FIG. 5A and the inset graph, the calibration curve for methane sensing is as follows:

$$I_{(0\text{-}10\%\ CH4)}(A/cm^2)=2.27\times10^{-5}\ (A/cm^2\%)\times C_{CH4}(\text{vol. }\%)+3.38\times10^{-4}\ (A/cm^2)\ (r^2=0.992).$$

Figure 5C:
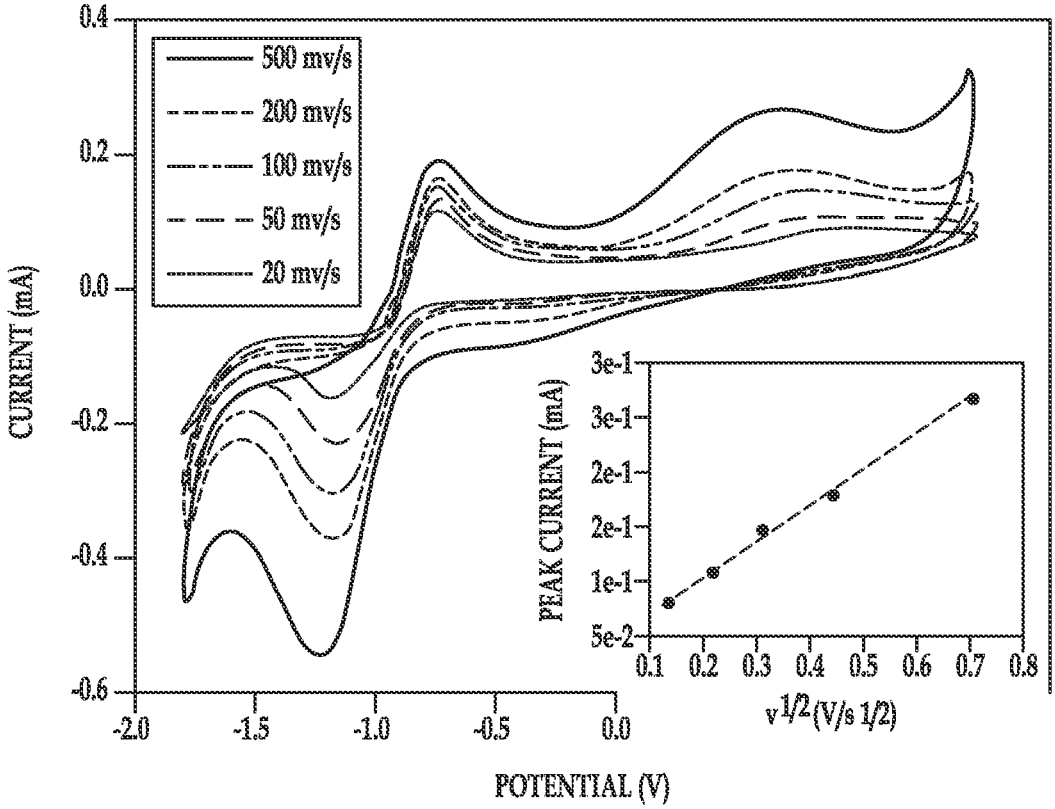
FIG. 5C depicts the cyclic voltammograms for 5 vol. % methane supplied to system 1 at different scan rates, where the inset is a plot depicting the relationship between the peak current and the square root of the scan rate.

From FIG. 5A, the linear relationship of the peak currents versus the methane concentrations confirms that the methane oxidation can be considered as a diffusion controlled process. To support the contention that methane oxidation can be considered as a diffusion controlled process, CV of system 1 with 5 vol. % methane were measured at different scan rates. These results are shown in FIG. 5C. The inset is a graph depicting the relationship between the peak current and the square root of the scan rate. The results in FIGS. 5A and 5C confirm that the kinetics of methane oxidation is very fast in the $[C_4mpy][NTf_2]$ electrolyte. Thus, both methane oxidation and oxygen reduction currents are determined by the surface active sites only. As such, the electrode activity for both methane and oxygen detection can be calibrated by the pure oxygen current or current density.

Figure 6A:
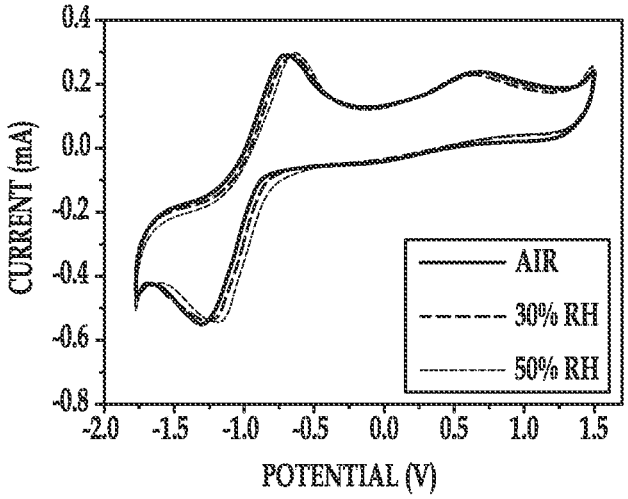
FIG. 6A depicts cyclic voltammograms which illustrate the effect of different water concentrations towards the oxygen redox process in air in system 1, where relative humidity is the unit for water concentration to mimic an ambient environment.

In situ infrared spectroelectrochemistry confirmed that the final methane oxidation products in $[C_4mpy][NTf_2]$ were $CO_2$ and water. Although the solubility of $CO_2$ in $[C_4mpy][NTf_2]$ is low, $CO_2$ and water generated in-situ from methane oxidation can significantly affect oxygen redox process. The effects of different water concentrations on the oxygen redox process in air in the $[C_4mpy][NTf_2]$ system 1 are shown in FIG. 6A and the effects of different $CO_2$ concentrations on the oxygen redox process in air in the $[C_4mpy][NTf_2]$ system 1 are shown in FIG. 6B.

The $[C_4mpy][NTf_2]$ used is hydrophobic which significantly minimized the amount of water adsorbed in this ionic liquid from the atmosphere. Furthermore, the oxidation of water in $[C_4mpy][NTf_2]$ is kinetically very slow, thus the reaction proceeds primarily between oxygen and methane. Even though the oxygen redox process is highly sensitive to the presence of water in other media, in pure $[C_4mpy][NTf_2]$ as shown in FIG. 6A, the current changes of the oxygen redox processes due to high humidity (RH: 30% or 50%), were very small compared with the dry air conditions. It is believed that this is due to the low solubility of water in this ionic liquid and the high stability of $O_2^-$ in this ionic liquid.

Figure 6B:
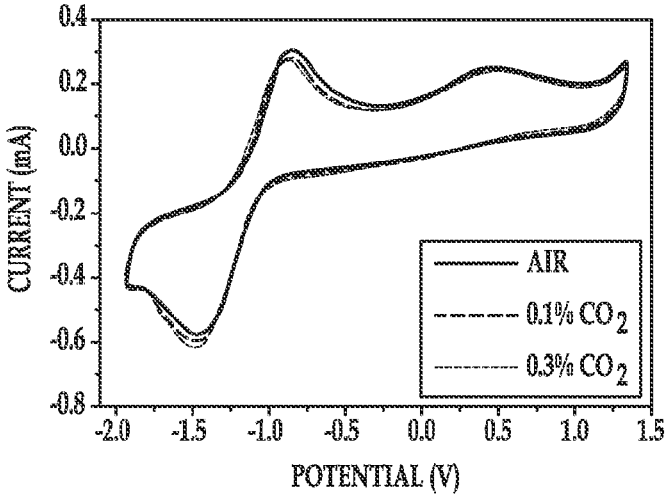
FIG. 6B depicts cyclic voltammograms which illustrate the effect of different carbon dioxide concentrations towards the oxygen redox process in air in system 1.

As shown in FIG. 6B, the $CO_2$ from the atmosphere (0.03 vol. %) has little interference to the oxygen detection. It is believed that this is due to both methane and oxygen having strong adsorption on the platinum surface, but $CO_2$ having very low solubility in $[C_4mpy][NTf_2]$, low adsorption on the platinum, and no adsorption at the activated platinum surface.

Referring now to FIG. 5B, the cathodic currents of oxygen reduction increase and both the oxygen reduction potentials and the superoxide oxidation peak potentials shift to the more positive values with increasing methane concentrations. The cathodic peak around −1.2 V is due to the oxygen reduction, which as described previously forms the reduced oxygen species (i.e., a superoxide radical, $O_2.^-$). Also in FIG. 5B, the anodic peak around −0.7 V is due to the superoxide radical $O_2.^-$ being re-oxidized to oxygen. These peaks in FIG. 5B illustrate that the reversible redox signals of the $O_2/O_2.^-$ redox coupled reaction are strong in the ionic liquid containing $[C_4mpy]^+$ cation. The shoulder peak at −0.8 V appeared only after the second CV cycle, supporting that water and $CO_2$ are produced by methane oxidation.

Figure 7A:
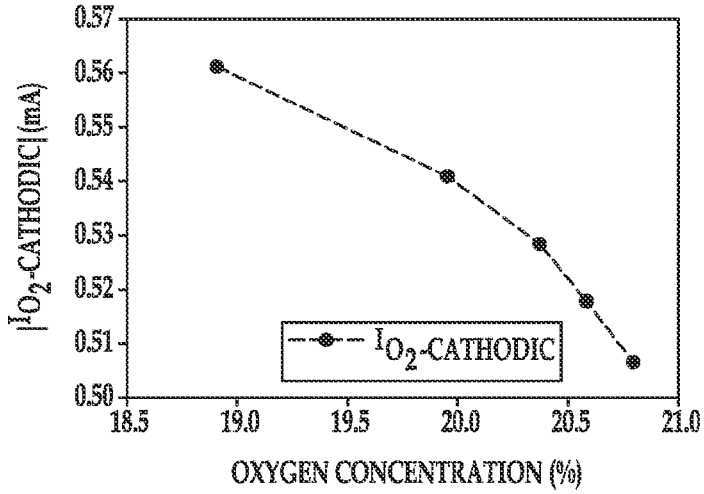
FIG. 7A is a graph depicting the oxygen cathodic current values from FIG. 5B plotted against oxygen concentration.

The oxygen reduction currents from FIG. 5B were plotted as a function of oxygen concentration. These results are shown in FIG. 7A. As depicted, the oxygen reduction currents do not follow a linear relationship with the oxygen concentrations.

Figure 7B:
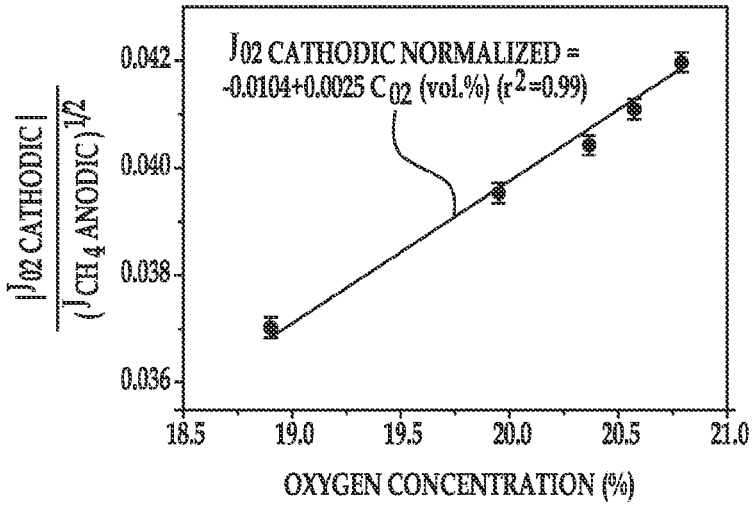
FIG. 7B is a calibration curve depicting the normalized oxygen cathodic current density versus oxygen concentration.

The peak oxygen cathodic current densities ($|j_{O2\text{-}cathodic}|$) (calculated from the currents of FIG. 5B) were normalized by the square root of the methane anodic current densities $(i_{CH4\text{-}anodic})^{1/2}$ (calculated from the currents of FIG. 5A). The methane anodic current densities were for the 1 vol. % to 10 vol. % methane range (i.e., 1 vol. %, 2 vol. %, 3 vol. %, 5 vol. %, and 10 vol. %). The normalized values were plotted as a function of oxygen concentration (oxygen was from 21 vol. % to 18.9 vol. %), and the resulting calibration curve is shown in FIG. 7B. As depicted, the ratio of oxygen current density to the square root of methane oxidation current density as a function of oxygen analyte concentration is linear. The trend of current density value with oxygen concentration is consistent with the results for double potential step chronoamperometry (discussed below).

Using linear regression in FIG. 7B, the concentration of oxygen could be determined by the equation shown, namely:

$$j_{O2\text{-}cathodic\ normalized}=-0.0104+0.0025C^*_{O2}(\text{vol. }\%)\quad (r^2=0.99).$$

Double Potential Step Chronoamperometry

Double potential step chronoamperometry was used to test systems 1 and 2 with the $[C_4mpy][NTf_2]$ ionic liquid. For this example, a multiple potential step method was applied to each system in the presence of air (no methane introduced) or methane and air. The vol. % of oxygen in the air ranged from 20 vol. % to 21 vol. %. Since 5.0 vol. % methane is the lower explosion limit in air, a concentration range for practical detection is from 0 vol. % to 5 vol. % methane. This range was tested in the instant example.

Double potential step chronoamperometry real time results were recorded for methane oxidation at 0.9 V and oxygen reduction at −1.2 V. More specifically, current density transients were recorded at these two switched potentials in response to stepwise (1%) changes in the methane concentration. The DC potential was switched from 0.9 V to −1.2 V at each concentration. As such, at each concentration of methane, the DC potential was applied near the methane oxidation potential (about 0.9 V) for 300s and then it was stepped to −1.2 V for 300 s to allow oxygen reduction for 300 s. The same potential program was repeated eleven different times at the different methane concentrations (from 1-5 vol. % in air).

The time constant (τ) obtained from a potential step experiment (in which the potential was stepped from 0.0 V to 0.9V in 100% air) was 6 seconds (i.e., the time required for current decays to 37% maximum current). Thus, in order to minimize the double layer charging current due to methane adsorption, the current was measured in this example at the $300^{th}$ second, which is 50τ. The double layer charging current is negligible at 300 seconds and the current can be attributed to mainly faradic current.

Figure 8A:
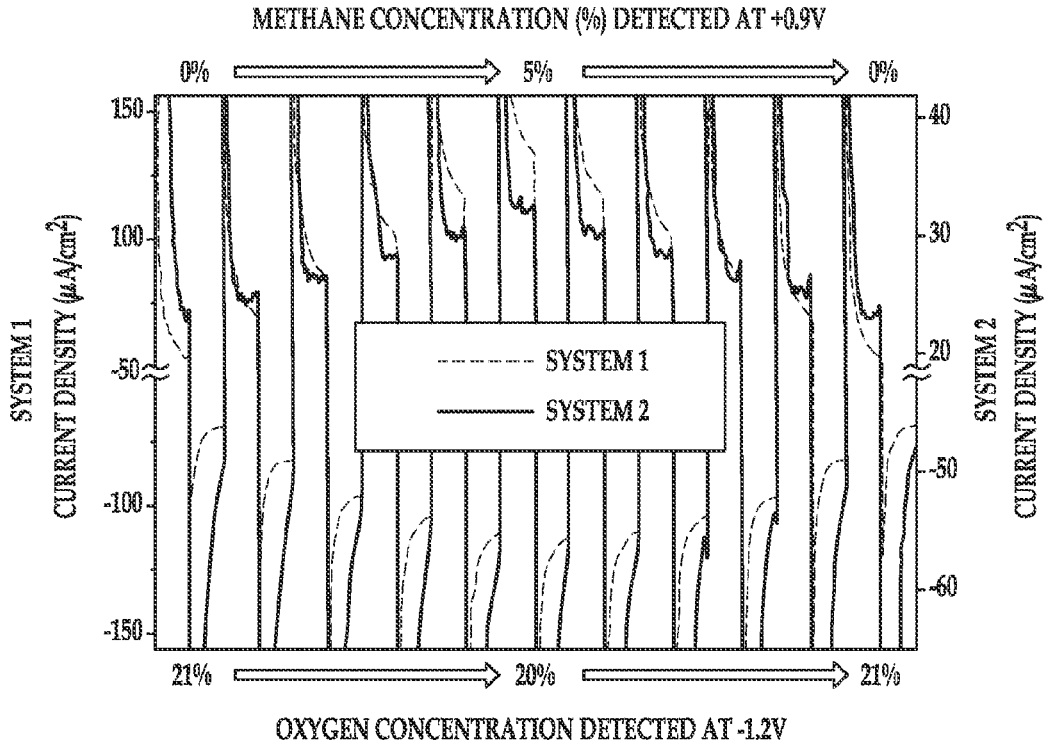
FIG. 8A depicts the current density transients recorded for system 1 (left Y-axis) and for system 2 (right Y-axis) in response to two switched potentials with stepwise (1 vol. %) changes in methane concentrations, where system 2 included $[C_4mpy][NTf_2]$ as the ionic liquid electrolyte and a platinum interdigitated electrode.

As noted above, system 1 included the Pt gauze macroelectrode and system 2 included the Pt IDE. The results from the double step potential chronoamperometry are shown in FIG. 8A.

Figure 8B:
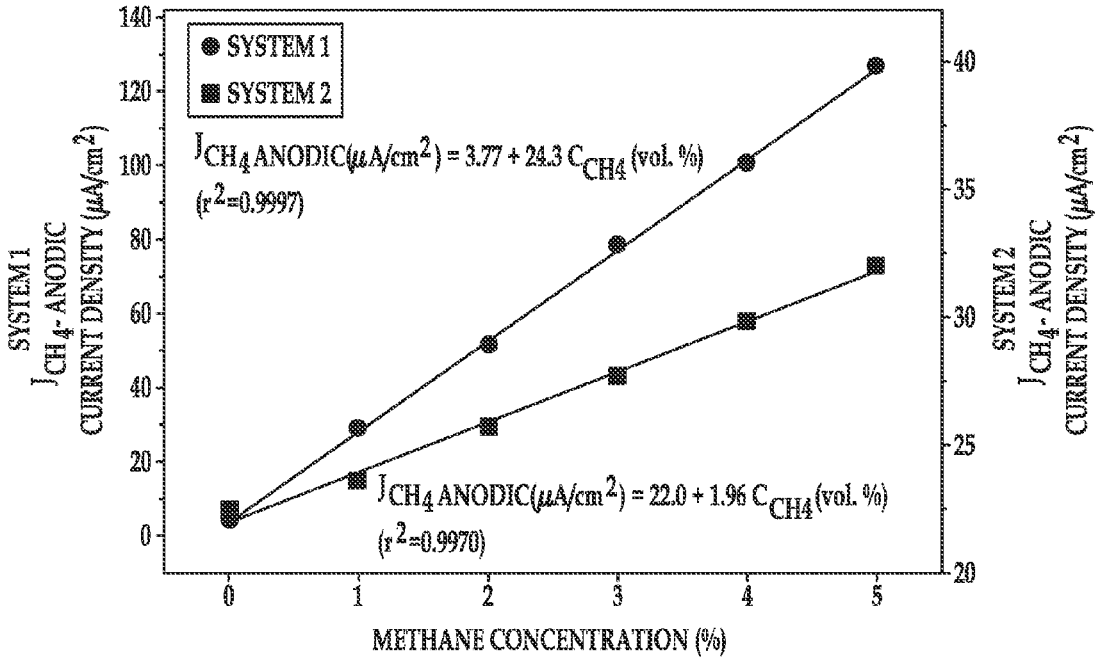
FIG. 8B is a graph depicting the methane anodic current density values from FIG. 8A for system 1 (left Y-axis) and system 2 (right Y-axis) plotted against methane concentration.

Very reversible current responses were obtained on each of systems 1 and 2. The stable current outputs from methane oxidation provide very robust and sensitive signals related to methane concentration change. The methane concentration was quantified using linear regression and the anodic current density at 0.9 V directly, as shown in FIG. 8B. Linear regression gave the coefficient of linearity of $r^2>0.98$. The calibration curve for methane sensing using system 1 and double potential step chronoamperometry is represented by the following equation:

$$j_{(0\text{-}5\%\ CH4)}(A/\text{cm}^2)=2.42\times10^{-5}\,(A/\text{cm}^2\%)\times C_{CH4}(\text{vol. }\%)+3.77\times10^{-6}\,(A/\text{cm}^2)\ (r^2=0.9997).$$

It is noted that the calibration curve for methane sensing using cyclic voltammetry is different from the calibration curve for methane sensing using double potential step chronoamperometry because the mass transport relationship of the analyte in the two techniques are different.

Figure 8C:
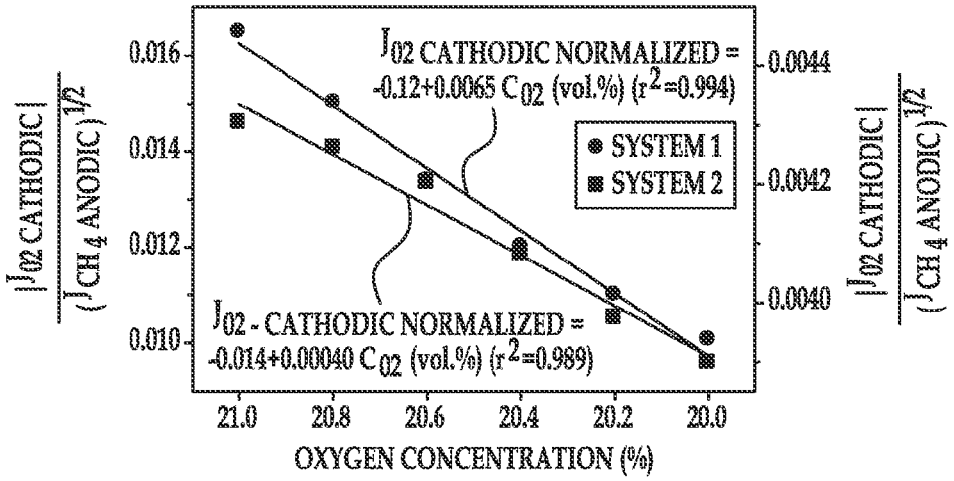
FIG. 8C is a calibration curve depicting the normalized oxygen cathodic current density for system 1 (left Y-axis) and the normalized oxygen cathodic current density for system 2 (right Y-axis) versus oxygen concentration.

The oxygen concentrations were measured using an example of the internal standard method disclosed herein. More particularly, the peak oxygen cathodic current densities for each of the systems 1 and 2 ($|j_{O2\text{-}cathodic}|$) (from FIG. 8A) were normalized, respectively, by the square root of the methane anodic current densities $(j_{CH4\text{-}anodic})^{1/2}$ for each of the systems 1 and 2 (from FIG. 8B). The normalized values were plotted as a function of oxygen concentration (oxygen was from 21 vol. % to 20.0 vol. %), and the resulting calibration curve is shown in FIG. 8C. As depicted, the ratio of oxygen current density to the square root of methane oxidation current density as a function of oxygen analyte concentration is linear.

Using linear regression in FIG. 8C, the concentration of oxygen could be determined by the equation shown for system 1 (with the Pt gauze macroelectrode):

$$j_{O2\text{-}cathodic\ normalized}=-0.12+0.0065C^*_{O2}(\text{vol. }\%)\quad (r^2=0.994)$$

and by the equation shown for system 2 (with the Pt IDE):

$$j_{O2\text{-}cathodic\ normalized}=-0.014+0.0004C^*_{O2}(\text{vol. }\%)\quad (r^2=0.989)$$

With double potential step chronoamperometry, accurate concentrations of methane and oxygen in air can be determined using the single ionic liquid sensor. In this example, higher sensitivity was obtained from system 1 (including the Pt gauze macroelectrode) than system 2 (including the Pt planar interdigited electrode). It is believed that this is due to the 3D structure and highly activated platinum gauze electrode. Given these results, the microfabricated planar Pt IDE patterned on the PTFE membrane may be more suitable for a low power, low cost, wearable sensor platform. Furthermore, the IDE is functional even when it is bended, so it may be adhered to any substrate having any geometric configuration or may be integrated with other devices.

Single Potential Step Chronoamperometry

Single potential step chronoamperometry was also used to test system 1 with the $[C_4mpy][NTf_2]$ ionic liquid. A potential of 0.9 V was applied to the Pt working electrode. After a 300 s current decline, at which point charging current becomes negligible, the sensor was exposed to an air stream with methane introduced at increasing amounts and then decreasing amounts. The concentration of methane was increased or decreased 1 vol. % at each step, up to 5 vol. % and then back to down to 0 vol. %. The background current without methane was offset to zero.

Figure 9A:
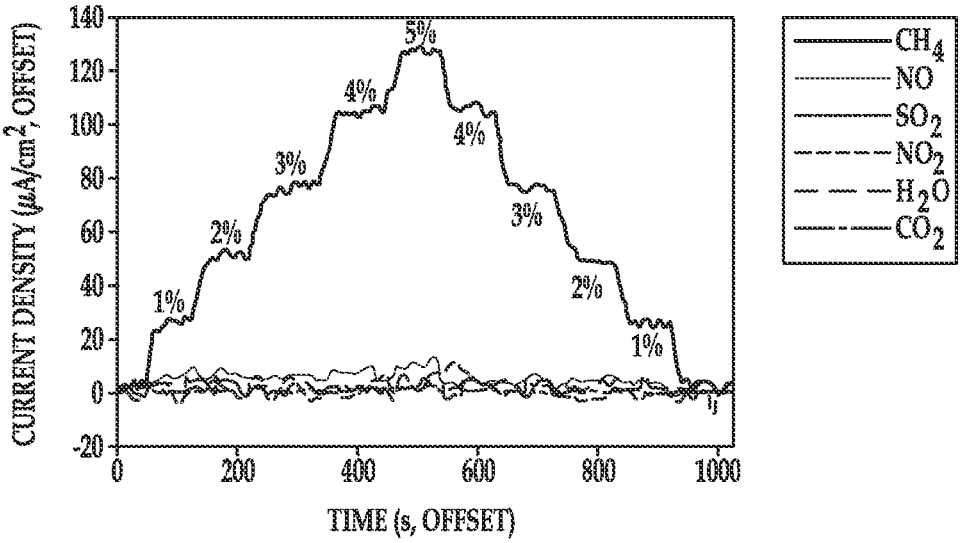
FIG. 9A is a graph depicting the real-time response of system 1 when exposed to single stepwise increases and decreases of methane concentrations from 0 to 5 vol. % and other common interference gases in the air.

FIG. 9A illustrates the real-time response of system 1 to single stepwise increases and decreases of methane concentrations from 0 to 5 vol. %. The current change is quantitative and reproducible upon the addition of methane or the removal of methane at each step, indicating the stability of the electrode surface. The response time ($T_{90}$) was about 20 seconds, including the gas mixing and mass flow controller operating time. The dose-dependent relationship shown in FIG. 9A is almost identical to the results observed for double potential step chronoamperometry.

Figure 9B:
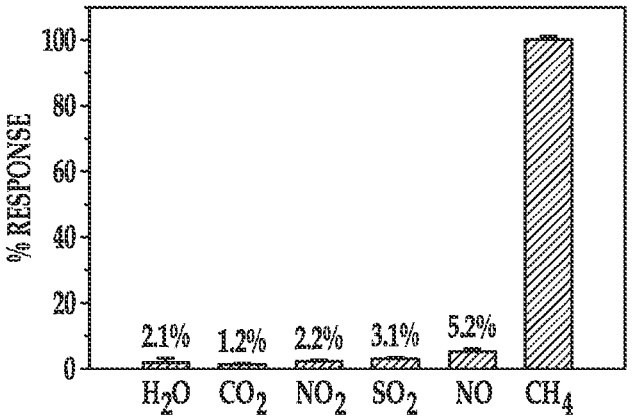
FIG. 9B is a chart depicting the % current response of system 1 to non-target gases present at 5.0 vol. % in air relative to 5.0 vol. % methane in air.

Non-target gases were also introduced to system 1 at 5 vol. % in air. FIG. 9B shows the current response of system 1 to the non-target gases present at 5.0 vol. % in air relative to 5.0 vol. % methane in air based on the single potential-step method. The number appearing over each bar denotes the selectivity coefficient for methane over a given gas, based on the respective current ratio. Excellent selectivity (more than 100:1) is shown under aerobic conditions because little anodic oxidation current peak is observed for other tested interfering gases.

Bulk $CO_2$ did not interfere with methane detection as $CO_2$ is already in its fully oxidized state. Furthermore, there was no significant interference from $NO_2$ or $SO_2$. Both $NO_2$ and $SO_2$ are principle constituents of acidic gas pollutants in the atmosphere and no oxidation peaks were observed between 0.5 V to 1.5 V. NO could interfere with methane oxidation under atmospheric conditions, because of the oxidation of NO (NO to $NO^+$) at positive potentials in the ionic liquid. Any oxidation peak(s) of NO in $[C_4mpy][NTf_2]$ was/were not clearly, and if they were present, the NO oxidation peak(s) likely overlapped with the methane oxidation peak. However, it is believed that the influence of NO was decreased by the presence of oxygen since NO quickly reacts with $O_2$ under room temperature to form $NO_2$. This process is beneficial to system 1, because the methane sensor is intended to be used to monitor methane in atmospheric conditions—in which there is very little NO due to the rapid oxidation process of NO to $NO_2$.

The typical concentration of NO, $NO_2$, and $SO_2$ in air is very low. The maximum allowed exposure concentrations of these gases was only a few ppm in air, and thus their interferences are negligible in practical methane sensor applications.

In the examples disclosed herein, the oxygen redox process in air (or pure oxygen) introduced into the system is used as a probe to evaluate the electrode activity and gas sensitivity. The oxygen uniquely has a role in the formation of the interface complex and the reactive oxygen species that catalyzes oxidation of the adsorbed alkane and also can be measured as an analyte. Since the concentration of the alkane and oxygen in an environment is correlated, the oxygen concentration can be quantified using methane oxidation current/current density as an internal standard. This approach enables the sensor system to be calibrated by the oxygen reduction or re-oxidation current or current density, and increases the methane sensor reliability by cross-validating the measurement results.

It is to be understood that the ranges provided herein include the stated range and any value or sub-range within the stated range. For example, a range from about 18° C. to about 30° C. should be interpreted to include not only the explicitly recited limits of about 18° C. to about 30° C., but also to include individual values, such as 20° C., 24.5° C., 27° C., etc., and sub-ranges, such as from about 20° C. to about 25° C., from about 19° C. to about 26° C., etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed:

1. A method for simultaneously quantifying an alkane and oxygen using a single sensor, the method comprising:

supplying an alkane gas to an interface between an activated surface of a platinum or palladium working electrode and an ionic liquid electrolyte, whereby the alkane adsorbs at or near an interface complex formed at the interface, wherein the ionic liquid electrolyte is a 1-alkyl-1-methylpyrrolidinium bis(trifluoromethylsulfonyl)imide selected from the group consisting of 1-ethyl-1-methylpyrrolidinium bis(trifluoromethylsulfonyl)imide, 1-propyl-1-methylpyrrolidinium bis(trifluoromethylsulfonyl)imide, 1-butyl-1-methylpyrrolidinium bis(trifluoromethylsulfonyl)imide, 1-pentyl-1-methylpyrrolidinium bis(trifluoromethylsulfonyl)imide, 1-hexyl-1-methylpyrrolidinium bis(trifluoromethylsulfonyl)imide, 1-heptyl-1-methylpyrrolidinium bis(trifluoromethylsulfonyl)imide, 1-octyl-1-methylpyrrolidinium bis(trifluoromethylsulfonyl)imide, 1-nonyl-1-methylpyrrolidinium bis(trifluoromethylsulfonyl)imide, and 1-decyl-1-methylpyrrolidinium bis(trifluoromethylsulfonyl)imide, and combinations thereof;

supplying the alkane gas in the presence of oxygen to the interface;

while the alkane gas in the presence of oxygen is supplied to the interface, applying a positive electrode potential to the platinum or palladium working electrode, thereby causing oxidation of the adsorbed alkane to form a reaction product;

quantifying a concentration of the alkane using an alkane anodic current or an alkane anodic current density at the positive electrode potential; and using the alkane as an internal standard to calibrate oxygen detection.

2. The method as defined in claim 1 wherein prior to using the alkane as the internal standard, the method further includes applying a negative electrode potential to the platinum or palladium working electrode, thereby reducing the oxygen to form a reduced oxygen species.

3. The method as defined in claim 2, wherein prior to using the alkane as the internal standard and after applying the negative electrode potential, the method further comprises identifying an oxygen cathodic current or an oxygen cathodic current density at the negative electrode potential, the oxygen cathodic current or the oxygen cathodic current density being related to a square root of a concentration of the reaction product and the concentration of the reaction product being proportional to the alkane anodic current or the alkane anodic current density.

4. The method as defined in claim 3 wherein using the alkane as the internal standard includes:

normalizing the oxygen cathodic current at the negative electrode potential using a square root of the alkane anodic current to generate a normalized oxygen cathodic current value; and calculating a concentration of the oxygen using the normalized oxygen cathodic current value and linear regression fitting.

5. The method as defined in claim 3 wherein using the alkane as the internal standard includes:

normalizing the oxygen cathodic current density at the negative electrode potential using a square root of the alkane anodic current density to generate a normalized oxygen cathodic current density value; and calculating a concentration of the oxygen using the normalized oxygen cathodic current density value and linear regression fitting.

6. The method as defined in claim 2 wherein applying the positive electrode potential and applying the negative electrode potential is accomplished using chronoamperometry.

7. The method as defined in claim 6 wherein the chronoamperometry is accomplished using a double potential step method which includes:

applying the positive electrode potential for a first predetermined amount of time;

switching the positive electrode potential to the negative electrode potential; and applying the negative electrode potential for a second predetermined amount of time.

8. The method as defined in claim 7, further comprising:

switching the negative electrode potential back to the positive electrode potential; and applying the positive electrode potential for a third predetermined amount of time.

9. The method as defined in claim 7 wherein:

the electrode potentials are referenced to a quasi platinum reference electrode;

the reaction product is carbon dioxide;

the positive electrode potential is 0.9 V or a more positive electrode potential; and the negative electrode potential is −1.2 V or a more negative electrode potential.

10. The method as defined in claim 2 wherein the reduced oxygen species reacts with the reaction product of alkane oxidation to regenerate oxygen.

* * * * *